US006251171B1

(12) United States Patent
Marra et al.

(10) Patent No.: US 6,251,171 B1
(45) Date of Patent: Jun. 26, 2001

(54) AIR CLEANER

(75) Inventors: Johannes Marra; Arjen Boogaard, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/274,393

(22) Filed: Mar. 23, 1999

(30) Foreign Application Priority Data

Mar. 23, 1998 (EP) ..... 98302136

(51) Int. Cl.[7] ..... B03C 3/08
(52) U.S. Cl. ..... 96/69; 96/79; 96/96
(58) Field of Search ..... 96/96, 69, 77–79

(56) References Cited

U.S. PATENT DOCUMENTS

| | | | | |
|---|---|---|---|---|
| 3,289,392 | * | 12/1966 | Fowler | 96/77 X |
| 3,485,011 | * | 12/1969 | Archer et al. | 96/96 X |
| 3,999,964 | * | 12/1976 | Carr | 96/77 X |
| 4,018,577 | * | 4/1977 | Shibuya et al. | 96/78 |
| 4,231,766 | * | 11/1980 | Spurgin | 96/79 |
| 4,349,359 | * | 9/1982 | Fitch et al. | 96/96 X |
| 4,666,474 | * | 5/1987 | Cook | 96/96 X |
| 4,689,056 | | 8/1987 | Noguchi et al. | 96/79 |
| 4,822,381 | * | 4/1989 | Mosley et al. | 96/96 X |
| 5,037,456 | * | 8/1991 | Yu | 96/96 X |
| 5,059,219 | * | 10/1991 | Plaks et al. | 96/77 |
| 5,330,559 | | 7/1994 | Cheney et al. | 95/63 |
| 5,993,521 | * | 11/1999 | Loreth et al. | 96/69 |

FOREIGN PATENT DOCUMENTS

| | | | | |
|---|---|---|---|---|
| 596290 | * | 4/1960 | (CA) | 96/77 |
| 2427759A1 | | 1/1976 | (DE) . | |
| 2448979A1 | | 4/1976 | (DE) . | |
| 892908 | | 4/1962 | (GB) . | |

* cited by examiner

*Primary Examiner*—Richard L. Chiesa
(74) *Attorney, Agent, or Firm*—Ernestine C. Bartlett

(57) ABSTRACT

An electrostatic air cleaner includes a corona charging section and a precipitation section. The charging section includes a first and a second array of substantially parallel earth wires, each array being disposed in a respective plane substantially perpendicular to the direction of air flow, and a third array of substantially parallel corona wires sandwiched between the first and second arrays. With this design, the spacing between earth wires and the spacing between corona wires can be selected independently to obtain the most favorable corona discharge conditions. The arrangement also enables easy cleaning of the earth wires.

7 Claims, 2 Drawing Sheets

AIR CLEANER

BACKGROUND OF THE INVENTION

This invention relates to air cleaners, and particularly to electrostatic air cleaners.

Various electrostatic air cleaner designs have been proposed. One significant advantage of electrostatic designs is the possibility to reduce the pressure drop across the air cleaner, when compared to conventional mechanical filter air cleaners. A high pressure drop gives rise to the need for a powerful fan in order to provide the desired air flow rate, causing noisy operation of the air cleaner.

Conventional electrostatic air cleaners comprise a charging section for charging particles in the air stream through the filter, and a dust precipitation section. The pressure drop across the air cleaner can be arranged to be near zero. The charging section typically comprises a high voltage ioniser and may be arranged as a series of corona discharge electrodes, in the form of fine wires, sandwiched between ground plates. The conditions required for corona discharge will be known to those skilled in the art. Essentially, a sufficient electric field strength is required to ionise air molecules in the vicinity of the corona discharge electrodes. The corona electrodes rapidly discharge ions of one polarity while ions of the opposite polarity drift along the electric field lines towards the ground plates. Particles entrained in the air stream become charged through collisions with these drifting ions.

An electrostatic air cleaner employing a corona discharge charging section of this type is described in U.S. Pat. No. 5,330,559.

A problem with electrostatic air cleaners of this kind is the cost and complexity of the components, including the voltage source, as a very high voltage can be required to sustain the corona discharge, for example 6 kV to 20 kV, as described in U.S. Pat. No. 5,330,559.

SUMMARY OF THE INVENTION

According to the present invention there is provided an air cleaner for removing particles contained in an air stream directed through the air cleaner, comprising a charging section for charging particles in the air stream and a precipitation section for capture of charged particles, wherein the charging section comprises a first and a second array of substantially parallel wires, each array being disposed in a respective plane substantially perpendicular to the direction of air flow, the wires of the first and second arrays being held at a first potential, and a third array of substantially parallel wires sandwiched between the first and second arrays, the wires of the third array being held at a second potential.

The design of charging section according to the invention requires three wired frames which provides a simple mechanical construction. Preferably the wires of the first and second arrays are earthed, and the wires of the third array are held at a corona discharge voltage. The design of the charging section is independent of the precipitation section design, so that both sections of the air cleaner may be optimised independently. Furthermore, the spacing between earthed wires and the spacing between corona wires can be selected independently to obtain the most favourable corona discharge conditions.

During operation of the filter, the arrays of earth wires in particular become gradually fouled with dust particles. Since the first and second arrays of earth wires are arranged at the periphery of the charging section, surrounding the corona discharge wires, they can easily be manually cleaned. Furthermore, the dust particles travelling through the filter will be charged before they reach the central array of corona discharge wires, and will therefore be repelled from the corona discharge wires. The corona wires are therefore less susceptible to fouling. The earth wires surrounding the corona wires also act as a partial Faraday cage, to minimise any influence of stray environmental electric fields on the corona discharge conditions.

Preferably, the wires of the three arrays are all parallel to each other. The wires of the first and second arrays may be equal in number and aligned with respect to the direction of air flow, and the wires of the third array may be offset from the wires in the first and second arrays with respect of the direction of air flow.

The offset of the wires in the third array (the corona discharge wires) ensures that electric field lines between the corona discharge wires and the ground wires intersect the air stream through the air cleaner. This ensures effective charging of the particles in the air stream. In addition, the charging section of the invention enables the spacing between the corona discharge wires to be selected independently of the spacing between the earth wires.

In a preferred embodiment there are fewer corona discharge wires than earth wires in the first or second arrays. It has been found that by increasing the spacing between the corona discharge wires (with respect to the spacing between earth wires) it is possible to reduce substantially the voltage at which corona discharge takes place. The increased spacing between the corona discharge wires gives rise to increased symmetry of the electric field around the corona wires, with less mutual influence of adjacent corona wires on the electric field pattern. This electric filed symmetry promotes a low corona onset voltage.

The earth wires of the first and second array preferably have diameter greater than 0.2 mm, and the corona wires of the third array preferably have diameter of 0.05 to 0.08 mm. A large thickness of the earth wires ensures mechanical robustness and enables each array of wires to be formed from a solid sheet of metal, by for example an etching process or a mechanical cutting or punching process.

The precipitation section of the air cleaner may comprise a series of alternate earth and high voltage parallel plates, each extending in a plane substantially parallel to the direction of air flow. This arrangement reduces to a minimum the pressure drop across the filter, so that a low power ventilator may be employed for providing air flow through the cleaner.

Alternatively, the precipitation section may comprise mechanical filter material sandwiched between two porous electrically-conducting gauzes, an electric potential difference being applied between the two gauzes to generate an electric field across the filter material. Although this introduces a slightly greater pressure drop, the improved dust filtering efficiency of this type of electrically-enhanced filter material may give rise to significant improvements in the overall performance of the air cleaner.

BRIEF DESCRIPTION OF THE DRAWINGS

The invention will now be described by way of example, with reference to and as shown in the accompanying drawings, in which.

DESCRIPTION OF THE PREFERRED EMBODIMENTS

Figure 1:
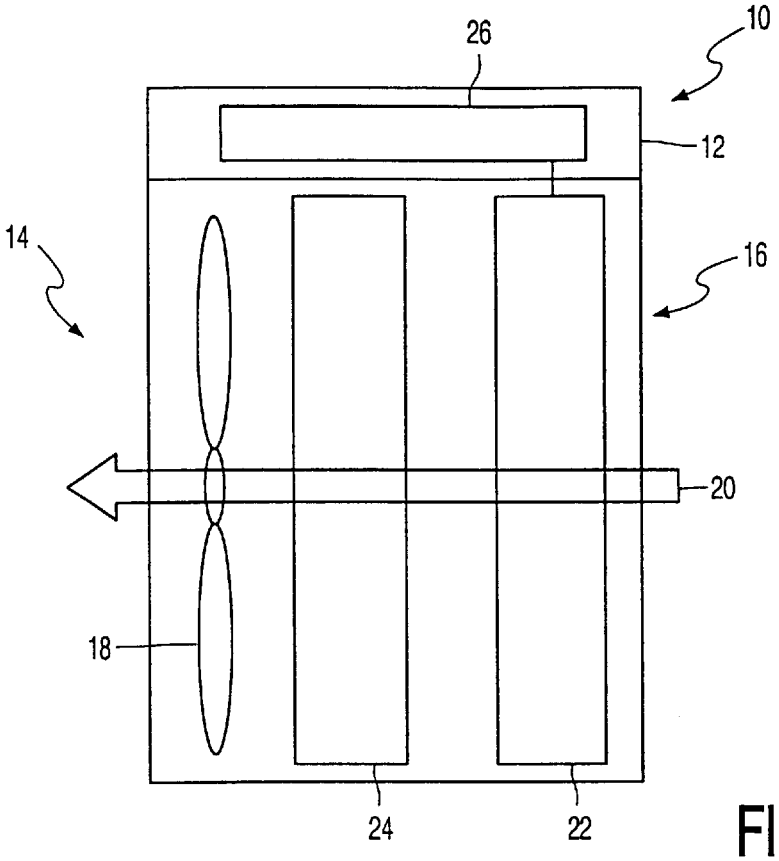
FIG. 1 shows schematically the essential components of an electrostatic air cleaner.

The air cleaner 10 shown in FIG. 1 comprises a casing 12 with an inlet 14 and an outlet 16. A fan 18 is provided for generating an airstream through the air cleaner 10 in the direction represented by arrow 20. The term "the direction of air flow" used in the following description and claims is intended to represent the general direction of air travel through the air cleaner as represented by arrow 20, although it will of course be appreciated that there will not be streamline air flow through the air cleaner 10, and the representation by arrow 20 is a simplification of the air flow conditions.

The air stream drawn into the filter by the fan 18 flows through a charging section 22 and a precipitation section 24. The charging section 22 charges the particles entrained in the air stream, and the precipitation section 24 is for the capture of those charged particles. The charging section 22 requires a high voltage supply to enable stable corona discharge, produced by a transformer 26.

The components described above are conventional in the art. An advantage of electrostatic air cleaners of this type is the low pressure drop across the charging section 22 and the precipitation section 24, which enables a low power fan 18 to be used, which therefore reduces the noise produced by the air cleaner. An example of a known charging section in an electrostatic air cleaner comprises a series of corona discharge wires sandwiched between parallel earth plates. One problem with this arrangement is the requirement for a high voltage transformer which increases the cost and weight of the air cleaner. Another problem is the need to clean the precipitation section, which is not a simple operation for narrowly spaced metal plates with corona wires sandwiched between them.

Figure 2:
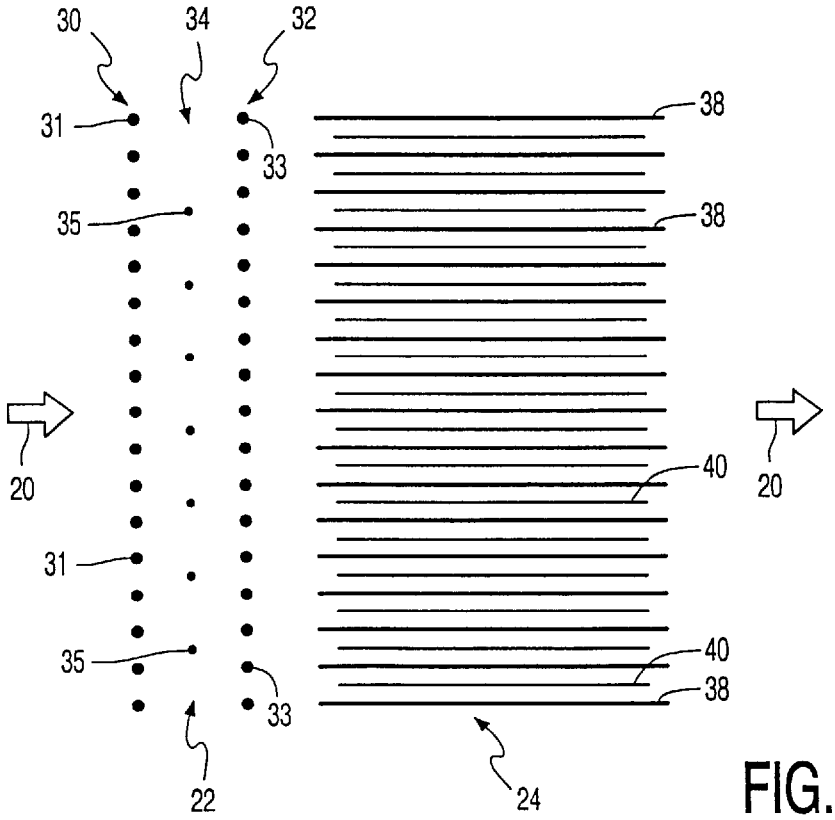
FIG. 2 shows one arrangement of charging section and precipitation section according to the invention.

FIG. 2 shows one embodiment of an electrostatic air cleaner according to the invention, although the fan and power supply are not shown, for simplicity.

The charging section 22 comprises first and second arrays 30,32 of earthed wires 31, 33. Each array 30,32 comprises a number of equally spaced parallel wires lying in a plane perpendicular to the direction of air flow 20. The wires 31 in the first array 30 are also parallel with the wires 33 in the second array 32, and the wires in the two arrays are aligned with respect to the direction 20 of air flow. The wires in the first and second arrays 30, 32 are held at ground potential and may, for example, comprise chromium-nickel wires having diameter of approximately 1.0 mm. Alternatively, the first and second arrays 30, 32 may each be obtained by chemical etching of a metal plate, in which case the wires could, for example, comprise stainless steel and have a thickness of at least 0.5 mm, to enable etching from a solid plate.

The two arrays are mounted with the smallest practical spacing between them, for example 10 mm. In the example shown in FIG. 2, the spacing between adjacent earth wires may be approximately 4 mm.

A third array 34 of corona discharge wires 35, held at a high voltage relative to the arrays 30 and 32, is disposed within the spacing between the first and second arrays 30, 32. The third array again comprises a series of parallel wires lying in a plane perpendicular to the direction of air flow. The corona wires should have the smallest possible diameter, and a diameter of approximately 0.05 mm is preferred, since any reduction in the diameter below this level results in mechanical weakness of the wires. The corona wires are preferably made from tungsten.

The corona wires are offset from the earth wires with respect to the direction of air flow. This ensures that the air stream crosses the electric field lines which are defined between the corona wires and the earth wires. It has been found that uniform dust particle charging requires all electric field lines to cross air flow lines.

In the example shown in FIG. 2, the spacing between corona wires (8 mm) is twice the spacing between earthed wires (4 mm). It has been found that the greater spacing between the adjacent corona wires than between the adjacent earth wires enables the use of a lower voltage supply to obtain corona discharge. In particular, the charging section 22 of the air cleaner shown in FIG. 2 requires a corona section supply voltage of less than 4.5 kV. A conventional power supply may be used for this purpose. The reduced corona discharge voltage is obtained by reducing the influence of the electric field from adjacent corona wires on the discharge conditions, by increasing the spacing between those wires.

The precipitation section 24 of the air cleaner shown in FIG. 2 comprises a series of alternate earth plates 38 and high voltage plates 40, extending parallel to each other and parallel to the direction of air flow through the air cleaner. In this way, the precipitation section introduces a negligible pressure drop. The plates in the precipitation section may have a thickness of approximately 0.5 mm. The voltage supplied to the high voltage plates, and the separation between adjacent plates defines the electric field strength between the plates. The same voltage source may be used for the high voltage plates as for the corona wires, and the spacing between adjacent plates may be approximately 2 mm.

It is desirable to enable the user to clean the precipitation section of the filter, to prevent clogging. Although this is possible with metal plates as described previously, it is preferable to provide a disposable arrangement. For this purpose, it is possible to use plasticized cardboard plates as the substrate for the plates of the precipitation section 24. These plates can be immersed in an electroless nickel bath. A layer of nickel of thickness 0.1 $\mu$m is enough to obtain a sufficient support to which a voltage can be applied. The precipitation section may then be disposable.

The overall design of air cleaner shown in FIG. 2 provides a low volume, high efficiency and quiet apparatus. The length of the plates in the precipitation section may be approximately 45 mm, so that the overall depth of the air cleaner may be of the order of 10 cm. With a face area of 0.08 $m^2$ the design shown may obtain an efficiency of a least 95% on particles of diameter 0.3 $\mu$m, at an air flow of 300 to 350 $m^3$ per hour.

Figure 3:
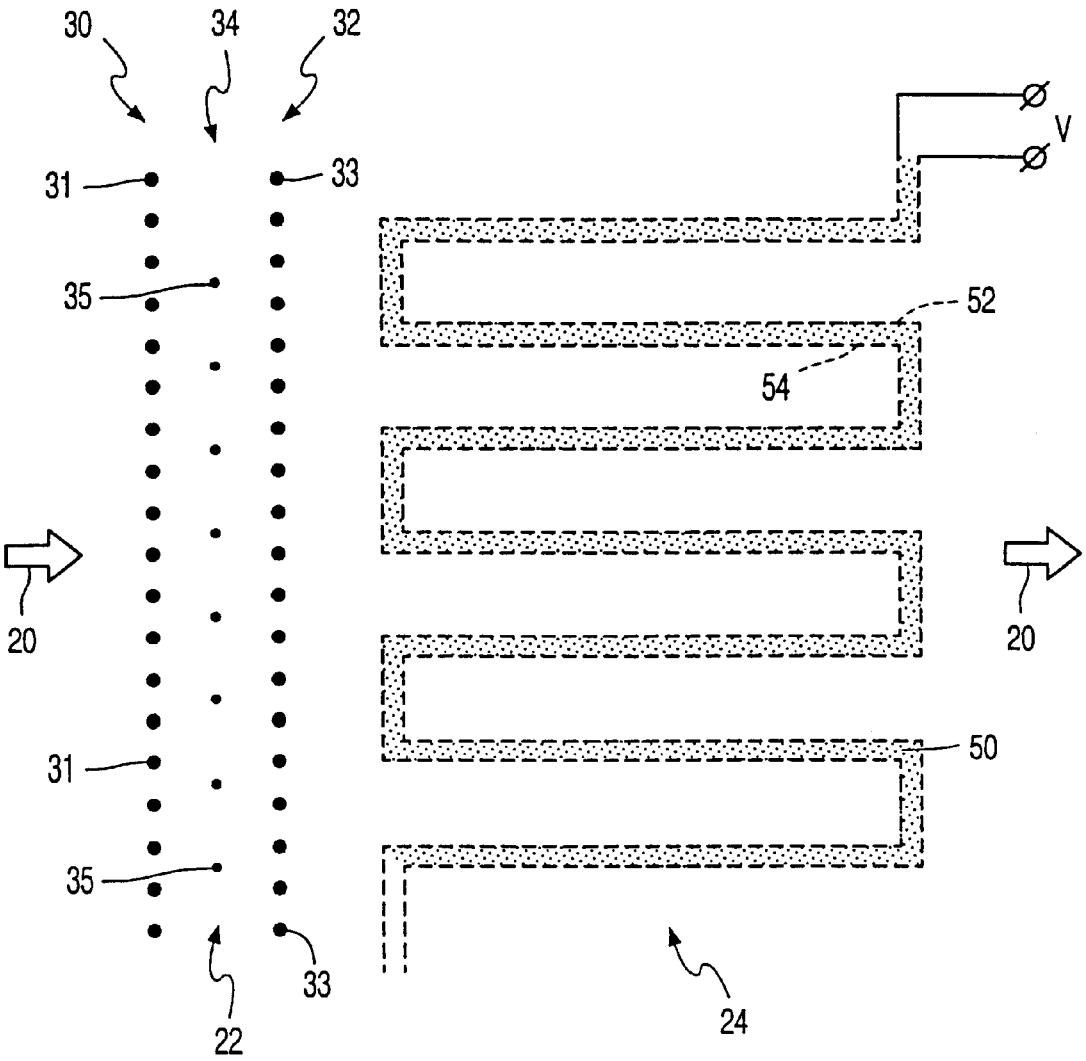
FIG. 3 shows an alternative arrangement of charging section and precipitation section according to the invention.

FIG. 3 shows a second embodiment of charging section and precipitation section for an air cleaner according to the invention. The charging section 22 of FIG. 2 is employed in the air cleaner shown in FIG. 3. However, the parallel plate precipitation section 24 of FIG. 2 has been replaced with a pleated fibrous filter 50 sandwiched between metal gauzes 52,54, with an electric potential difference V applied between the metal gauzes. This precipitation section thereby comprises an electrostatically-augmented fibrous filter arrangement. A field strength of approximately 1 kV/mm is applied across the fibrous filter (which has a thickness of approximately 3 mm) which allows the dust filtration efficiency to be increased further, although at the expense of a greater pressure drop than in the embodiment shown in FIG. 2. However, this pressure drop amounts to approximately 30 Pa, which still allows quiet operation of the fan. The fibrous arrangement is arranged to be disposable.

The voltage supply for the corona wires 35 may be used to generate the electric field across the filter material.

What is claimed is:

1. An air cleaner for removing particles contained in an air stream directed through the air cleaner, comprising a charging section for charging particles in the air stream and a precipitation section for capture of charged particles, wherein the charging section comprises a first and a second array of substantially parallel earthed wires of diameters approximately equal to or greater than 0.2 mm, each array being disposed in a respective plane substantially perpendicular to the direction of air flow, the wires of the first and second arrays being held at a first potential, and a third array of substantially parallel high voltage corona wires of diameters of 0.05 mm to 0.08 mm, sandwiched between the first and second arrays, the wires of the third array held at a second potential of at or less than 4.5 KV.

2. An air cleaner as claimed in claim 1, wherein the precipitation section comprises filter material sandwiched between two metal gauzes, an electric potential difference being applied between the two gauzes to generate an electric field across the filter material.

3. An air cleaner as claimed in claim 1, wherein the wires of the three arrays are all parallel to each other, and wherein the wires of the first and second arrays are equal in number and are aligned with respect to the direction of air flow, and the wires of the third array are offset from the wires in the first and second arrays with respect to the direction of air flow.

4. An air cleaner as claimed in claim 3, wherein there are fewer wires in the third array than in the first or second arrays.

5. An air cleaner as claimed in claimed in claim 1 wherein the first and second arrays are spaced by approximately 10 mm.

6. An air cleaner as claimed in claimed in claim 1, wherein the precipitation section comprises a series of alternate earthed and high voltage parallel plates, each extending in a plane substantially parallel to the direction of air flow.

7. An air cleaner as claimed in claim 6, wherein the parallel plates comprise metal-coated plasticized cardboard sheets.

* * * * *